US005718606A

United States Patent [19]

Rigby et al.

[11] Patent Number: 5,718,606

[45] Date of Patent: Feb. 17, 1998

[54] ELECTRICAL CONNECTOR BETWEEN A PAIR OF PRINTED CIRCUIT BOARDS

[75] Inventors: William J. Rigby, Somis; Scott S. Blaise; Thomas G. Conway, both of Camarillo, all of Calif.

[73] Assignee: Component Equipment Company, Inc., Camarillo, Calif.

[21] Appl. No.: 741,048

[22] Filed: Oct. 30, 1996

[51] Int. Cl.[6] ..... H01R 13/648

[52] U.S. Cl. ..... 439/608; 439/108

[58] Field of Search ..... 439/607–610, 439/101, 108, 63, 74

[56] References Cited

U.S. PATENT DOCUMENTS

| | | | |
|---|---|---|---|
| 3,966,290 | 6/1976 | Little et al. | 439/74 |
| 5,169,343 | 12/1992 | Andrews | 439/608 |
| 5,356,301 | 10/1994 | Champion et al. | 439/609 |
| 5,415,566 | 5/1995 | Brunker et al. | 439/608 |
| 5,509,823 | 4/1996 | Harting et al. | 439/931 |

*Primary Examiner*—Hien Vu
*Attorney, Agent, or Firm*—Jack C. Munro

[57] ABSTRACT

The subject invention is an electrical connector for a pair of printed circuit boards which utilizes a vertical pin header connected to one printed circuit board and a right angle receptacle connected to the other printed circuit board. The printed circuit boards are to be connected together by the electrical connector in a right angle relationship with one printed circuit board being located edgewise to the other printed circuit board. A mass of separate positive circuit paths is obtained from one printed circuit board to the other with the distance between contacts which form these circuit paths to be approximately two millimeters. The vertical pin header and the right angle receptacle are fixedly mounted on their respective printed circuit boards without the use of solder. The right angle receptacle matingly connects with the vertical pin header in only one position.

9 Claims, 2 Drawing Sheets

ELECTRICAL CONNECTOR BETWEEN A PAIR OF PRINTED CIRCUIT BOARDS

BACKGROUND OF THE INVENTION

1) Field of the Invention

This invention is related to electrical connectors and more particularly to an electrical connector that is to establish an electrical connection between printed circuit boards with there being a plurality of separate positive circuit paths being obtained through the electrical connector from one circuit board to the other circuit board.

2) Description of the Prior Art

Electronic components used in both telephone equipment and computers are commonly mounted on printed circuit boards. The printed circuit board is a sheet material-like member on which is mounted an electrical circuit and a plurality of electrical components such as capacitors, resistors and inductors. Within each piece of equipment there commonly is a plurality of printed circuit boards. It is necessary to connect together these printed circuit boards.

It is typical that an electrical connector between circuit boards will include between one to one thousand plus separate circuit paths. Each circuit path is commonly formed by a male/female contact arrangement. Within the prior art, the common form of connection of the circuit paths is to use a pin and socket type of connection with soldering then being used to fixedly secure together the pin and the socket to establish the desired electrical connection.

Miniaturization of electrical components is highly desirable. The smaller the physical size, the smaller the resultant electronic piece of equipment. The smaller the physical size of the electronic piece of equipment, the less space it requires when in operation. The smaller the size, the less the weight of the equipment thereby reducing shipping costs. In the past, miniaturization had been limited due to the requirement that a high speed, leakage-free electrical connection had to be achieved between the circuit paths between the printed circuit boards. As a result, due to manufacturing constraints there had to be at least four millimeters between each of the positive electrical contacts used in each circuit path that connected between the circuit boards. If the spacing between the contacts could be reduced, such as down to two millimeters, a substantial advantage of further miniaturization would be achieved. Also, the requirement to physically solder each of the electrical contacts is labor intensive and therefore rather expensive. If the connection between the printed circuit boards could be established with a solderless type of connection, such would be highly desirable.

SUMMARY OF THE INVENTION

The subject invention is an electrical connector formed of a vertical pin header and a right angle receptacle with the vertical pin header including a plurality of first contacts and the right angle receptacle including a plurality of second contacts. The center-to-center distance between each of the first contacts and between each of the second contacts is to be about two millimeters. Each of the first contacts are to be mounted within an appropriate receiving hole formed within a first printed circuit board with there being a separate hole for each first contact. Each of the second contacts are also mounted within an appropriate receiving hole formed within a second printed circuit board with there being a separate hole for each second contact. Each of the second contacts is elongated in the shape of a right angle. Each second contact is electrically connected with a first contact with the right angle receptacle matingly connecting with the vertical pin header. The right angle receptacle includes at least one deformable peg which is conducted through a mating opening formed within the printed circuit board on which it is mounted. The tip of the deformable peg extends outward from the back wall of the printed circuit board with the right angle receptacle being mounted on the front wall of the printed circuit board. The tip of the deformable peg is to be manually deformed (squashed) securely mounting the right angle receptacle onto the printed circuit board. The entire exterior surface of the vertical pin header and the right angle receptacle is coated with an electrically conductive layer. Surrounding each of the positive contacts that protrude from the header is a plurality of electrical contact points with these electrical contact points to connect with the electrically grounding layer. A similar series of electrical contact points surround each electrical contact protruding from the right angle receptacle. The electrical contacts of both the header and the right angle receptacle are each to be electrically connected to separate printed circuit boards. The right angle receptacle is to be matingly connected to the vertical pin header with the electrical grounding layers of both the vertical pin header and the right angle receptacle to be in contact with each other thereby electrically conductive there between.

The primary objective of this invention is to create a high performance, fully shielded electrical connector.

Another objective of the present invention is to construct an electrical connector to connect together printed circuit boards with the electrical connection there between being void of solder.

Another objective of the present invention is to construct an electrical connector which can be mounted on a printed circuit board in a substantially less amount of time than previous types of printed circuit boards because of the elimination of the need for soldering.

Another objective of the present invention is to arrange the electrically positive contacts mounted within the connector with a center-to-center spacing there between of only about two millimeters which is substantially less than previous types of high speed, shielded electrical connectors.

Another advantage of the present invention is that the total installed cost of the connector of the present invention is substantially lower than the prior art coaxial connector designs.

DETAILED DESCRIPTION OF THE PREFERRED EMBODIMENT

Figure 1:
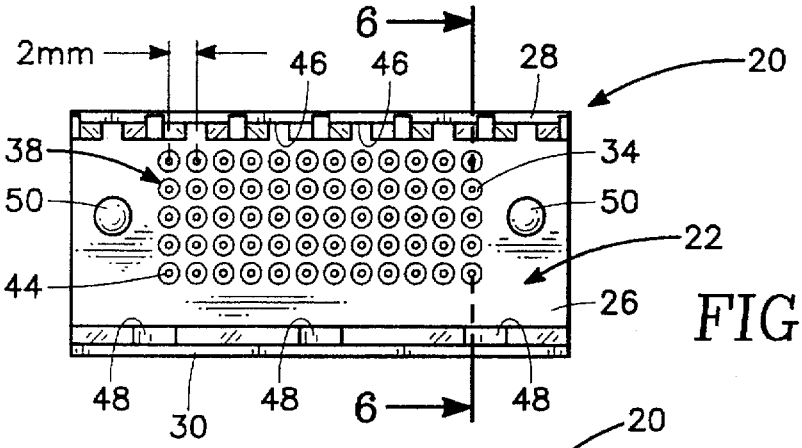
FIG. 1 is a top plan view of the vertical pin header which constitutes one portion of the electrical connector of the present invention.
Figure 2:
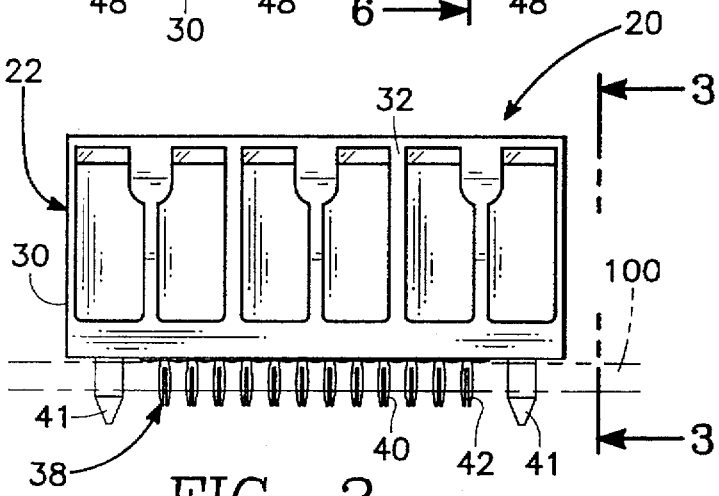
FIG. 2 is a front elevational view of the vertical pin header of FIG. 1.
Figure 3:
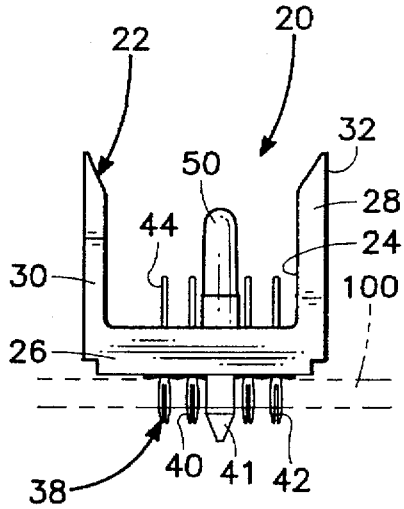
FIG. 3 is a right side view of the vertical pin header of the present invention taken along line 3—3 of FIG. 2.

Referring particularly to FIGS. 1–3 and 6, there is shown the vertical pin header 20 which is included within the electrical connector of this invention. The vertical pin header 20 is constructed of an electrically insulative housing 22 which is formed in transverse cross-section in a U-shape defining an open ended internal cavity 24. The open ended internal cavity 24 is formed by a base 26 from which extends at one side edge thereof a wall 28 and from the other side edge thereof a wall 30. Typical material of construction for the electrically insulative housing 22 would be a plastic. The entire exterior surface of the electrically insulative housing 22 is to be covered with an electrically conductive layer 32. Normally the electrically conductive layer 32 would be chemically plated onto the electrically insulative housing 22. Typical material for the electrically conductive layer 22 would be copper or a copper/nickel composition. Although the electrically insulative housing 22 is described as being completely covered with the electrically conductive layer 32, such is done solely for the reason of economy as it is less cost to completely cover housing 22 rather than only partially cover. It is considered to be within the scope of this invention that the electrically insulative housing 22 could be coated with an electrically conductive layer 32 in selective areas rather than completely coating the entire exterior surface of the electrically insulative housing 22.

Formed within the base 26 are a plurality of holes 34. The base 26 is shown to include sixty such holes 34. The holes 34 are evenly spaced apart with the desirable spacing between the centers of directly adjacent holes 34 being two millimeters. Mounted within each of the holes 34 is an insulative sleeve 36. Tightly mounted within each sleeve 36 is an, electrical contact 38 which has at its outer end thereof a prong 40. The prong 40 is elongated and is quadfurcated by means of a pair of centrally located slots 42 located perpendicular to each other. The aft end of the electrical contact 38 is formed into a post 44. The posts 44 of all the electrical contacts 38 are located within the confines of internal cavity 24. The internal surface of the wall 30 includes a series of grooves 46. The internal surface of the wall 28 include a series of recesses 48. The function of the grooves 46 and recesses 48 will be explained further on in the specification.

Also mounted within the base 26 are a pair of aligning posts 50. One aligning post 50 is mounted directly adjacent one longitudinal end of the base 26 with the other aligning post 50 being mounted directly adjacent the other longitudinal end of the base 26. In alignment with each post 50 but protruding from opposite side of base 26 is a deformable peg 41 with there being a separate peg 41 in alignment with each post 50. The function of the aligning posts 50 and deformable pegs 41 will also be explained further on in the specification.

Figure 4:
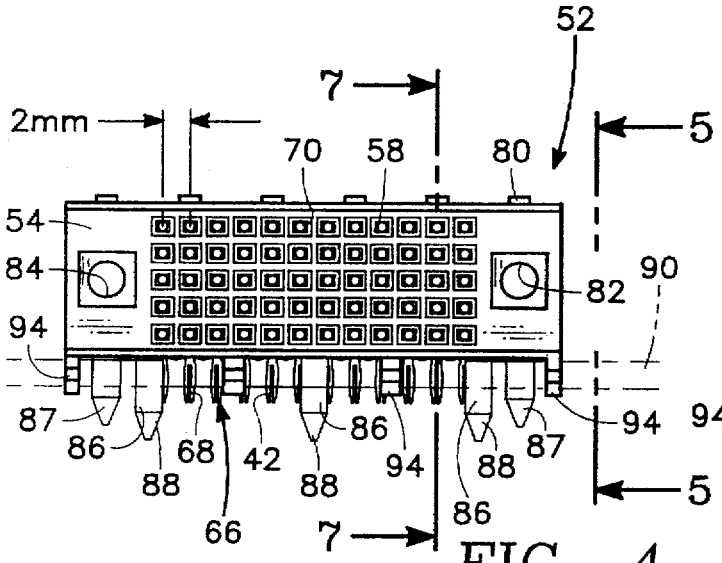
FIG. 4 is a top plan view of a right angle receptacle which constitutes a second portion of the electrical connector of the present invention.
Figure 5:
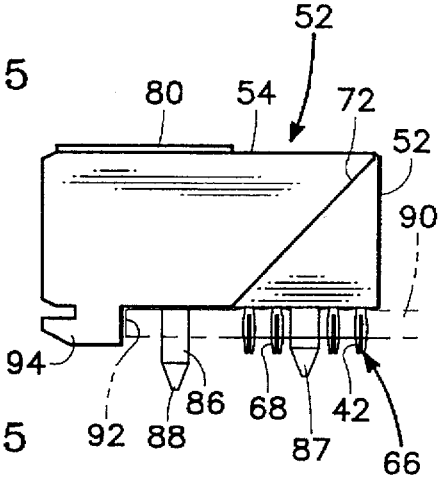
FIG. 5 is a right side view of the right angle receptacle taken along line 5—5 of FIG. 4.
Figure 6:
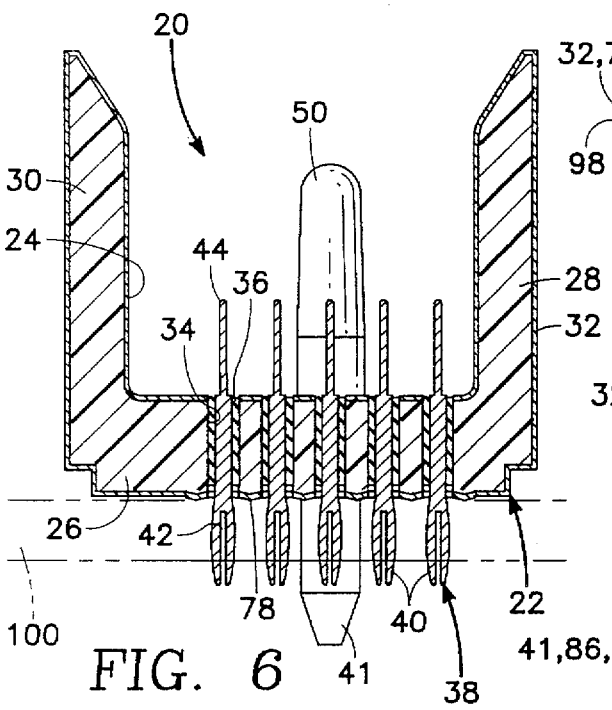
FIG. 6 is a cross-sectional view through the vertical pin header taken along line 6—6 of FIG. 1.
Figure 8:
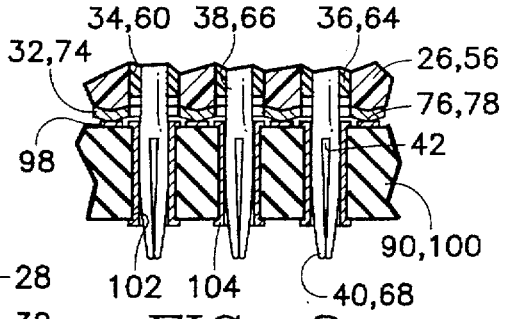
FIG. 8 is an enlarged cross-sectional view showing the connection of the contacts utilized in both the vertical pin header and the right angle receptacle showing their connection with a printed circuit board.
Figure 7:
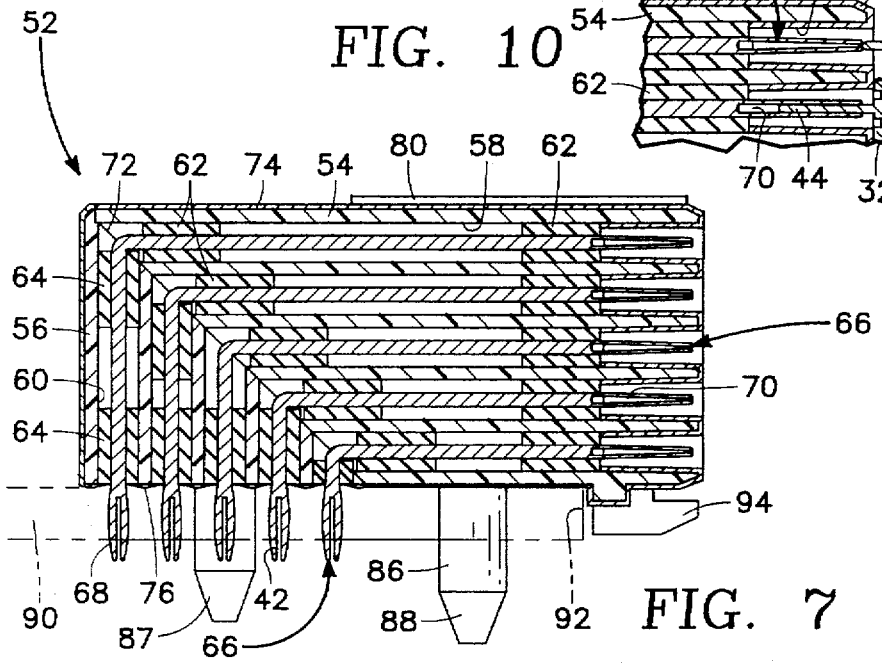
FIG. 7 is a cross-sectional view through the right angle receptacle taken along line 7—7 of FIG. 4.

Referring particularly to FIGS. 4, 5 and 7 of the drawings, there is shown a right angle receptacle 52. The right angle receptacle 52 is formed of a housing composed of housing section 54 and housing section 56. Housing section 54 includes a mass of through openings 58. In a similar manner, housing section 56 includes a mass of through openings 60. Material of construction of housing sections 54 and 56 will normally be of plastic. The number of the through openings 58 will also be sixty in number with the number of the through openings 60 being sixty in number. The spacing between the centers of directly adjacent the through openings 58 will be two millimeters with a similar spacing arrangement between the centers of the through openings 60. Mounted within each of the through openings 58 are a plurality of plastic sleeves 62. Mounted within each of the through openings 60 are a plurality of plastic sleeves 64. Within some of the through openings 60 there are only one in number of the plastic sleeves 64.

Mounted within each of the plastic sleeves 62, for each through hole 58, is an electrical contact 66. Electrical contact 66 is L-shaped in configuration with one end being formed into a prong 68 and the opposite end thereof being formed into a socket 70. It is to be noted that each of the electrical contacts 66 extend exteriorly of the housing section 54. This portion of the electrical contact 66, which includes the prong 68, is mounted in conjunction with one or two plastic sleeves 64 and extends through and outwardly from the housing section 56. When the electrical contacts 66 are all properly positioned within their respective openings 58 and 60, the housing sections 54 and 56 are bonded together at bond line 72.

The entire exterior surface of the housing sections 54 and 56 are to be covered with an electrically conductive layer 74 which is essentially identical in composition to the electrically conductive layer 32. Located between each of the prongs 68 are a series of contact points 76. These contact points constitute small protrusions of electrically conductive material which are in direct connection with the electrically conductive layer 74. There are normally four in number of the contact points 76 surrounding each prong 68. It is to be understood that there is no electrical connection between the contact points 76 and the prong 68.

It is to be understood that in the constructing of the connector of this invention that there is a very small amount of space, only two millimeters, between the center point of the prongs 68. It is absolutely necessary that there not be any electrical leakage between one positive contact 68 and another positive contact 68. In order to prevent this from occurring, this is why there is inserted the four in number of the contact points 76 around each of the prongs 68. The four in number of contact points 76, which are evenly spaced apart about each prong 68, insure that there is no leakage between directly adjacent prongs 68. It is envisioned that instead of using the four in number of contact points 76 that there actually could be used a ring. It also would be in the scope of this invention that a lesser number of contact points 76 could be used or possible a greater number of contact points 76. It is noted that in relation to the vertical pin header 20 there are also four in number of contact points 78 located around each of the prongs 40 with these contact points 78 being in electrical connection with the electrically conductive layer 32. The function of the contact points 76 and 78 will be explained further on the specification.

Fixedly mounted on the exterior surface of the housing section 54 are a plurality of ridges 80. There is to be a ridge 80 for each groove 46. In FIG. 4 it can be seen that there are six in number of the ridges 80 which are located evenly spaced apart. Therefore, there have to be six of the grooves 46, also evenly spaced apart, and spaced apart the same distance as the ridges 80. The housing section 54 includes a pair of aligning holes 82 and 84. One of the pins 50 is to be located within the aligning hole 84 and the other pin 50 within the aligning hole 82. This occurs when the right angled receptacle 52 is placed within the internal cavity 24 of the vertical pin header 20. The ridges 80 will each connect with a groove 46. Prior to making this connection, there is fixedly mounted to the housing 54 and extending outwardly therefrom a plurality of deformable pegs 86. The deformable pegs 86 are constructed of a deformable plastic material, and when deformed will remain in the deformed position. Each of the deformable pegs 86 include a tip 88. The deformable pegs 86 are to be connected through appropriate holes formed within a printed circuit board 90 with the edge 92 of the printed circuit board 90 being located directly adjacent protrusions 94. There are also an additional pair of deformable pegs 87 which engage with printed circuit board 90. The width of the protrusions 94 is about equal to the thickness of the printed circuit board 90. When inserting of the right angle receptacle 52 within the internal cavity 24, the protrusions 94 will ride against the interior surface of the wall 30. The tip 88 of each deformable peg 86 will slide within a recess 48. There are shown three in number of the deformable pegs 86 so therefore there are three in number of the recesses 48.

Figure 9:
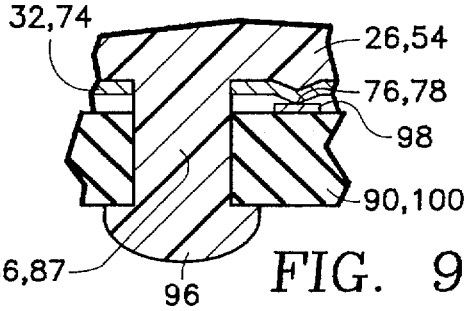
FIG. 9 is a cross-sectional view showing the deforming of the tip of a deformable mounting peg which is utilized in conjunction with the right angle receptacle for fixedly mounting of such to the printed circuit board.
Figure 10:
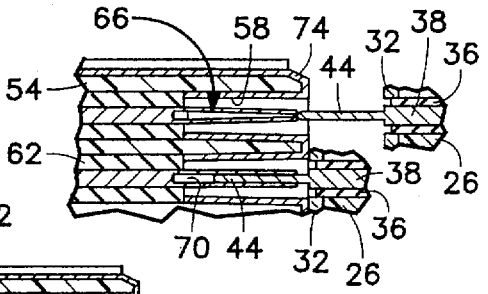
FIG. 10 is an enlarged, segmental, cross-sectional view depicting the interconnecting relationship between the contacts of the vertical pin header and the right angle receptacle.

When inserting of the right angle receptacle 52 within the internal cavity 24, there is established a tight or snug fit. Though tight, it is still capable of being manually separated and manually installed. During installation of the right angle receptacle 52 within the internal cavity 24, a post 44 is to be located within a socket 70. This will establish sixty in number of separate, positive electrical paths being composed of a contact 38 and a contact 66. The printed circuit board 90, when installed in conjunction with each of the deformable pegs 86, the tips 88 are squashed and deformed into rounded tip 96, as is clearly shown in FIG. 9 of the drawings, the printed circuit board 90 is then tightly mounted to the housing 54. Each of the contact points 76 or 78 will be in contact with a pad 98 which is mounted on the printed circuit board 90 and 100. This will establish the gas tight, electrical grounding connection between each contact point 76 and 78 and the printed circuit boards 90 and 100. In a similar manner, the prongs 40 extend through appropriate holes formed within printed circuit board 100. It is to be understood that each of the prongs 68 also include a pair of slots 42. Mounted within each printed circuit board 90 and 100 are sixty in number of holes 102. These holes 102 are also two millimeters spaced apart center-to-center. Mounted within each hole 102 is an electrically conductive sleeve 104. Each prong 68 is to form a gas tight connection with sleeve 104. The electrically conductive sleeve 104 is to be electrically connected (not shown) to an appropriate electrical circuit formed on the printed circuit boards 90 or 100.

With the printed circuit board 90 being mounted in conjunction with each of the prongs 68, a gas tight connection 15 formed and the printed circuit board 90 is oriented edgewise to the printed circuit board 100 which is then mounted on each of the prongs 40. Thereby the electrical connector of this invention is to be used to connect a plurality of the printed circuit boards 90 to a printed circuit board 100, which may be known as the mother board, which is commonly used in telephone equipment and computers. Once the right angle receptacle 52 is mounted in conjunction with the vertical pin header 20, it is to be understood that it can be manually disengaged therefrom for the purpose of replacing of a defective printed circuit board 90.

What is claimed is:

1. An electrical connector comprising:

an insulative housing having a plurality of holes, said housing having an exterior surface and electrical positive contacts each mounted within each of said holes with there being a separate said electrical positive contact for each of said holes;

an electrically conductive grounding layer covering at least a portion of said exterior surface of said housing, said electrically conductive grounding layer being chemically plated onto said housing, said electrically conductive grounding layer being located directly adjacent to each of said holes;

a plurality of contact points are integrally formed from said electrically conductive grounding layer, each of said contact points comprising a protrusion, said contact points electrically connecting with said electrically conductive grounding layer, said contact points located directly adjacent and surrounding each of said holes for facilitating electrical grounding connections with a printed circuit board; and deformable mounting pegs fixedly mounted on said housing, each of said mounting pegs extending outwardly from said housing, said mounting pegs being located directly adjacent said plurality of holes, each of said mounting pegs having an outer free end defined as a tip, whereby each of said mounting pegs is to be received within a mating opening of the printed circuit board with said tip protruding through said mating openings of said printed circuit board and then said tip is to be physically squashed tightly locking said housing to the printed circuit board.

2. The electrical connector as defined in claim 1 wherein:

said electrically conductive grounding layer covering substantially entirely said exterior surface of said housing.

3. The electrical connector as defined in claim 1 wherein:

there being four in number of said contact points for each of said holes.

4. The electrical connector as defined in claim 1 wherein:

center-to-center distance between said electrical positive contacts being approximately two millimeters.

5. An electrical connector for making an electrical connection between a pair of printed circuit boards with one board located edgewise to the other board, said electrical connector comprising:

a vertical pin header having a plurality of through holes formed in said header, electrical positive first contacts each mounted within each of said through holes, first alignment means mounted on said vertical pin header, said first contacts adapted to establish an electrical connection with one of the printed circuit boards;

a right angle receptacle having a plurality of through openings, electrical positive second contacts each mounted within each of said through openings, wherein each of said second contacts being elongated and in a shape of a right angle, second alignment means mounted on said right angle receptacle, said first alignment means being received in said second alignment means and said first contacts electrically connecting with said second contacts when said vertical pin header is matingly connected with said right angle receptacle, said second contacts adapted to establish an electrical connection with the other of the printed circuit boards; and said vertical pin header including a first housing constructed of an insulative material, said vertical pin header having a first exterior wall surface, a first electrically conductive grounding layer covering substantially the entire said first exterior wall surface, a plurality of first contact points integrally formed from said first electrically conductive grounding layer, wherein each of said first contact points comprising a small protrusion, said first contact points surrounding each of said electrical positive first contacts for facilitating electrical grounding connection with a respective printed circuit board.

6. The electrical connector as defined in claim 5 wherein:

said right angle receptacle including a second housing constructed of an electrically insulative material, said right angle receptacle having a second exterior wall surface, a second electrically conductive grounding layer covering at least a portion of said second exterior wall surface, a plurality of second contact points mounted on said right angle receptacle and electrically connected with said second electrically conductive grounding layer, each of said second contact points comprising a protrusion, there being a plurality of said second contact points surrounding each of said through openings.

7. The electrical connector as defined in claim 6 wherein:

said second electrically conductive grounding layer covering the entire surface of said right angle receptacle.

8. The electrical connector as defined in claim 6 wherein:

there being four in number of said first contact points surrounding each of said through holes and four in number of said second contact points surrounding each of said through openings.

9. The electrical connector as defined in claim 5 wherein:

center-to-center distance between said electrical positive first contacts being approximately two millimeters.

* * * * *